US009498780B2

(12) United States Patent
Watts et al.

(10) Patent No.: US 9,498,780 B2
(45) Date of Patent: Nov. 22, 2016

(54) GRINDING MILL WITH CABLE GRINDING ARMS

(71) Applicants: Gary L. Watts, Raytown, MO (US); Keith H. O'Brien, Lee's Summit, MO (US); Dennis P. O'Brien, Lee's Summit, MO (US)

(72) Inventors: Gary L. Watts, Raytown, MO (US); Keith H. O'Brien, Lee's Summit, MO (US); Dennis P. O'Brien, Lee's Summit, MO (US)

( * ) Notice: Subject to any disclaimer, the term of this patent is extended or adjusted under 35 U.S.C. 154(b) by 1099 days.

(21) Appl. No.: 13/623,379

(22) Filed: Sep. 20, 2012

(65) Prior Publication Data

US 2014/0077010 A1 Mar. 20, 2014

(51) Int. Cl.

*B02C 13/282* (2006.01)
*B02C 13/14* (2006.01)
*B02C 13/28* (2006.01)

(52) U.S. Cl.

CPC ..... *B02C 13/282* (2013.01); *B02C 13/14* (2013.01); *B02C 2013/2808* (2013.01); *B02C 2013/2816* (2013.01)

(58) Field of Classification Search

CPC ..... B02C 2013/2816; B02C 13/14; B02C 13/16; B02C 13/18; B02C 13/1807; B02C 13/1814; B02C 13/1821; B02C 13/28; B02C 13/282

See application file for complete search history.

(56) References Cited

U.S. PATENT DOCUMENTS

| | | | | |
|---|---|---|---|---|
| 24,058 | A | | 5/1859 | Russell |
| 134,513 | A | | 1/1873 | Chichester |
| 1,977,771 | A | | 10/1932 | McMahan |
| 2,087,492 | A | | 7/1937 | Williams |
| 2,160,695 | A | | 5/1939 | Brannon |
| 2,700,512 | A | * | 1/1955 | Denovan ..... B02C 13/14 241/154 |
| 2,838,246 | A | | 6/1958 | Adorno et al. |
| 3,579,717 | A | | 5/1971 | Middlebrooks |
| 4,029,263 | A | | 6/1977 | Wilkinson et al. |
| 4,087,052 | A | | 5/1978 | Rohrbach |
| 4,202,078 | A | | 5/1980 | Malinak |
| 4,637,561 | A | | 1/1987 | Edberg |
| 4,690,338 | A | | 9/1987 | Sayler et al. |
| 5,188,500 | A | | 2/1993 | Eide et al. |
| 5,192,029 | A | | 3/1993 | Harris |
| 5,340,036 | A | | 8/1994 | Riley |
| 5,680,994 | A | | 10/1997 | Eide et al. |
| 5,685,498 | A | | 11/1997 | McCoy |
| 5,685,500 | A | | 11/1997 | Eide et al. |
| 5,692,688 | A | | 12/1997 | Waitman et al. |

(Continued)

OTHER PUBLICATIONS

International Search Report and the Written Opinion of the International Searching Authority in International Application No. PCT/US/2010/040353, which claims priority from U.S. Appl. No. 12/493,470.

*Primary Examiner* — Matthew G Katcoff
(74) *Attorney, Agent, or Firm* — Erickson Kernell IP, LLC

(57) ABSTRACT

A grinding mill is described. The grinding mill includes a vertically oriented cylindrical housing with an intake chute in a top wall and an outlet chute in a bottom wall thereof. A shaft is disposed coaxially within the cylindrical housing. Mounting plates are disposed along the length of the shaft. The cables are coupled to the mounting plates with opposite ends of each cable extending radially outwardly from the mounting plates toward but not into contact with an inner wall of the housing. A plurality of obstructing members extends inwardly from the wall of the housing to slow the flow of materials through the mill. Baffles are disposed on the interior wall of the housing to direct materials and airflow. The cables are rotated to contact and grind materials deposited into the grinding mill and to generate airflow through the mill.

18 Claims, 7 Drawing Sheets

(56) References Cited

U.S. PATENT DOCUMENTS

| | | | |
|---|---|---|---|
| 5,697,563 | A | 12/1997 | Fujimoto et al. |
| 6,227,473 | B1 | 5/2001 | Arnold |
| 6,726,133 | B2 | 4/2004 | Hahn et al. |
| 6,991,189 | B2 | 1/2006 | Hahn et al. |
| 7,055,769 | B2 | 6/2006 | Pierce |
| 7,533,837 | B2 | 5/2009 | Schweiger et al. |
| 7,950,601 | B2 | 5/2011 | Watts |
| 2009/0126608 | A1 | 5/2009 | Borissov et al. |
| 2011/0095113 | A1 | 4/2011 | Waznys et al. |

* cited by examiner

GRINDING MILL WITH CABLE GRINDING ARMS

BACKGROUND

Grinders, shredders, or mills are well known devices for reducing the particle size of a material. For example, U.S. Pat. No. 5,192,029 to Harris (hereinafter Harris) and U.S. Pat. No. 5,680,994 to Eide et al. (hereinafter Eide) each disclose mills for grinding garbage. Each of theses mills includes a rotor rotatably mounted in a generally octagonal housing. The rotor includes a generally vertical shaft and a plurality of blades or hammers mounted on the shaft. Garbage is admitted into the housing through an inlet near the top of the housing and is impacted by the blades of the rotor. Material of a reduced particle size is removed from the mill through an outlet near the bottom of the housing. The ground garbage can be sent to a landfill where it will take up less room than unprocessed garbage, or it can be composted or recycled depending on the included materials. If the material is to be shipped, it can be shipped more efficiently due to its reduced size and greater density.

The mill of Eide also includes a fan or impeller that is mounted on the rotor shaft below the cutting blades. The fan is intended to create airflow that acts to move material through the mill and to expel it from the outlet. The airflow also aids to remove moisture from the material as it is being ground. The fan generally comprises a fan disc mounted to the rotor shaft. The fan disc includes a plurality of radially extending lengths of angle iron mounted thereon. One flange of each angle iron is fixedly bolted to the fan disc and the other extends upwardly from the disc to act as a fan blade.

Grinding mills such as those described by Harris and Eide have several drawbacks. All or parts of the blades may sheer off during grinding operations. Pieces of the blades can be torn away from the blade via contact with the materials being ground or the blades themselves can be torn or ripped away from their coupling with the rotor. The loose blade portions can damage other blades and components inside the grinder and are likely discharged through the outlet as contaminates in the ground materials. Another drawback to these designs is the need for the fan or impeller to generate airflow through the grinder. These add additional components and complexities to the manufacture and maintenance of the grinder. It would be advantageous to provide a grinder with non-rigid grinding blades or grinding arms and that does not require a fan or impeller to generate airflow therethrough.

SUMMARY

Embodiments of the invention are defined by the claims below, not this summary. A high-level overview of various aspects of the invention are provided here for that reason, to provide an overview of the disclosure, and to introduce a selection of concepts that are further described in the Detailed-Description section below. This summary is not intended to identify key features or essential features of the claimed subject matter, nor is it intended to be used in isolation to determine the scope of the claimed subject matter. In brief, this disclosure describes, among other things, a vertical grinding mill or grinder with grinding arms comprised of sections of cable.

The grinder includes a vertically oriented cylindrical housing with an inlet opening near the top and an outlet near the bottom thereof. A rotatable shaft is disposed in the housing and coaxially therewith. A plurality of mounting plates is affixed in spaced apart relation along the shaft. A plurality of sections of cable, such as high-strength steel crane cable, is attached to each of the plates. Each section of cable is attached along its midsection, such that opposite ends of the cable extend radially outwardly away from the shaft and form grinding arms. A plurality of baffles and obstructing members, such as bolts or studs, extend radially inward from a sidewall of the housing and are positioned vertically offset from the mounting plates and cables.

In operation, rotation of the shaft and thus, the grinding arms, at about 1,700 revolutions per minute (RPM) generates an airflow through the grinder that exits the outlet at about 20 miles per hour (MPH) without the use of fan blades or impellers. Materials are deposited into the grinder through the inlet and are ground, milled, pulverized, or otherwise reduced to particulate by contact with the grinding arms. The baffles and obstructing members direct and obstruct the vertical and circumferential flow of the material to aid in grinding by the grinding arms.

The cable sections provide flexibility to avoid shearing or destruction of the grinding arms during grinding and can be easily replaced. Ends of the cable sections can include collars or weldments that aid in grinding and decrease fraying of the cable.

DESCRIPTION OF THE DRAWINGS

Illustrative embodiments of the invention are described in detail below with reference to the attached drawing figures, and wherein.

DETAILED DESCRIPTION

Figure 1:
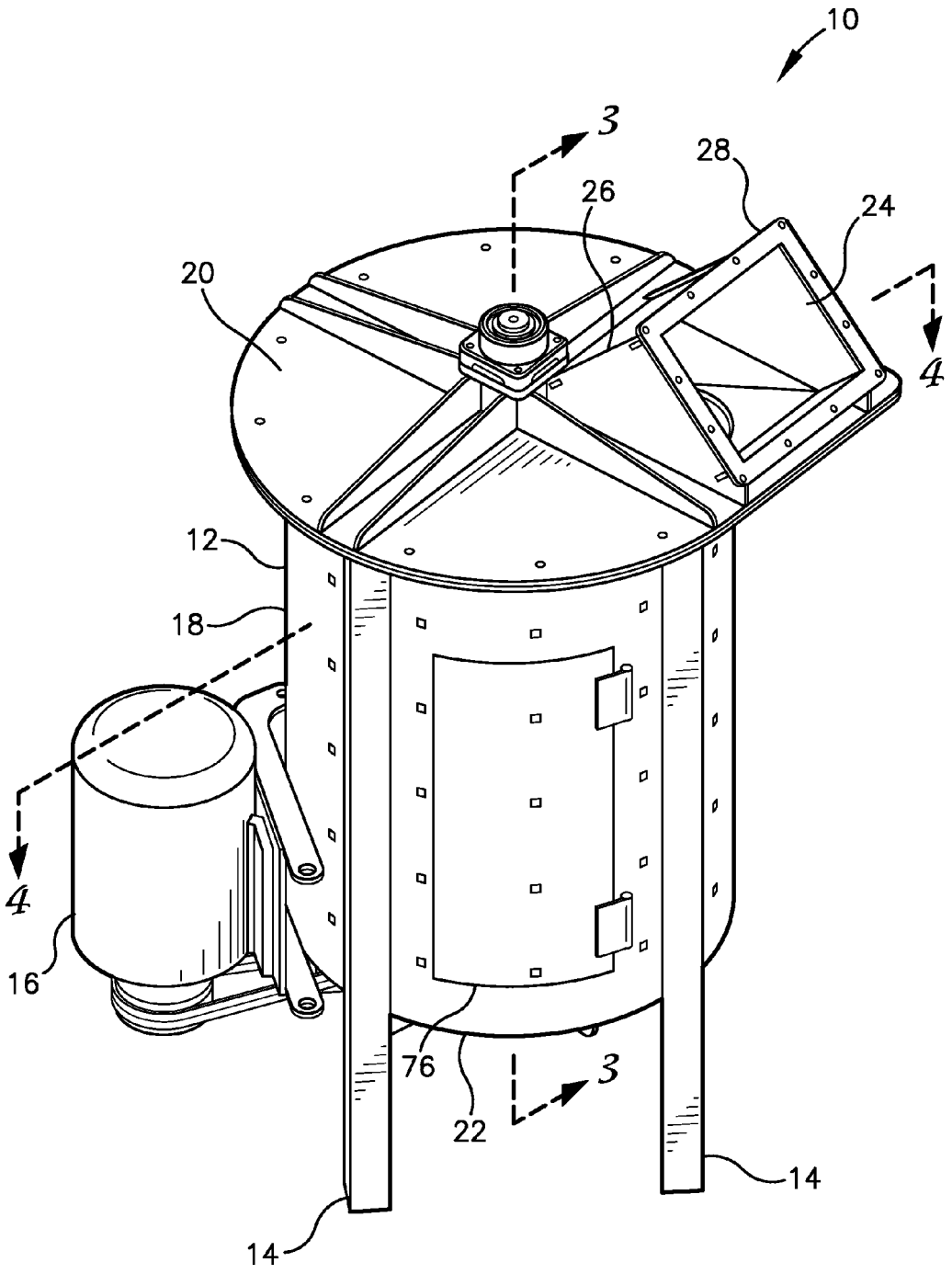
FIG. 1 is a perspective front side view of a grinding apparatus depicted in accordance with an embodiment of the invention.

The subject matter of select embodiments of the invention is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

Embodiments of the invention are described herein with respect to the drawings in which reference numerals are employed to identify particular components or features. Similar elements in the various embodiments depicted are provided with reference numerals having matching second and third digits but with differing first digits, e.g. element 10 is similar to elements 110, 210, etc. Such is provided to avoid redundant description of similar features of the elements but is not intended to indicate the features or elements are necessarily the same.

With reference to FIGS. 1-5, a grinding mill 10 is described in accordance with an embodiment of the invention. The grinding mill 10, also referred to interchangeably herein as the grinder, comprises a housing 12, with a plurality of legs 14, and a motor 16 coupled thereto. The legs 14 comprise any structures suitable to support the grinder 10 during operation thereof. As shown in FIGS. 1-5, the legs 14 comprise sections of angle iron welded to the exterior of the housing 12. The motor 16 is mounted to the exterior of the housing 12 and comprises any desired motor available in the art that is suitable to provide operation of the grinder 10 as described herein, e.g. an electric or hydraulic motor.

The housing 12 is substantially cylindrical with an annular wall 18 extending vertically between a top end-wall 20 and bottom end-wall 22. The grinding mill 10 is described herein as comprising a vertically oriented grinding mill however, other orientations of the grinder 10 or housing 12 might be employed in embodiments of the invention.

The top end-wall 20 includes an intake chute 24 or other opening through which materials to be ground can be deposited into the grinder 10. The intake chute 24 includes a passageway 26 that extends from the top end-wall 20 at an angle and may be curved to follow an arcuate path into the housing 12. The passageway 26 aids to direct materials entering the housing 12 along the arcuate path and in a generally horizontal or downward spiraling direction, e.g. the materials are not simply dropped vertically through the housing 12. The passageway 26 might induce cyclonic action or flow of the materials within the housing 12. The intake chute 24 includes a mounting flange 28 along a distal edge thereof for mounting to material delivery components, such as conveyors, ducting, or the like (not shown). A lower wall 27 of the passageway 26 may extend below the top end-wall 20 and within or exterior to the annular wall 18 to further direct the materials along the arcuate path.

Figure 2:
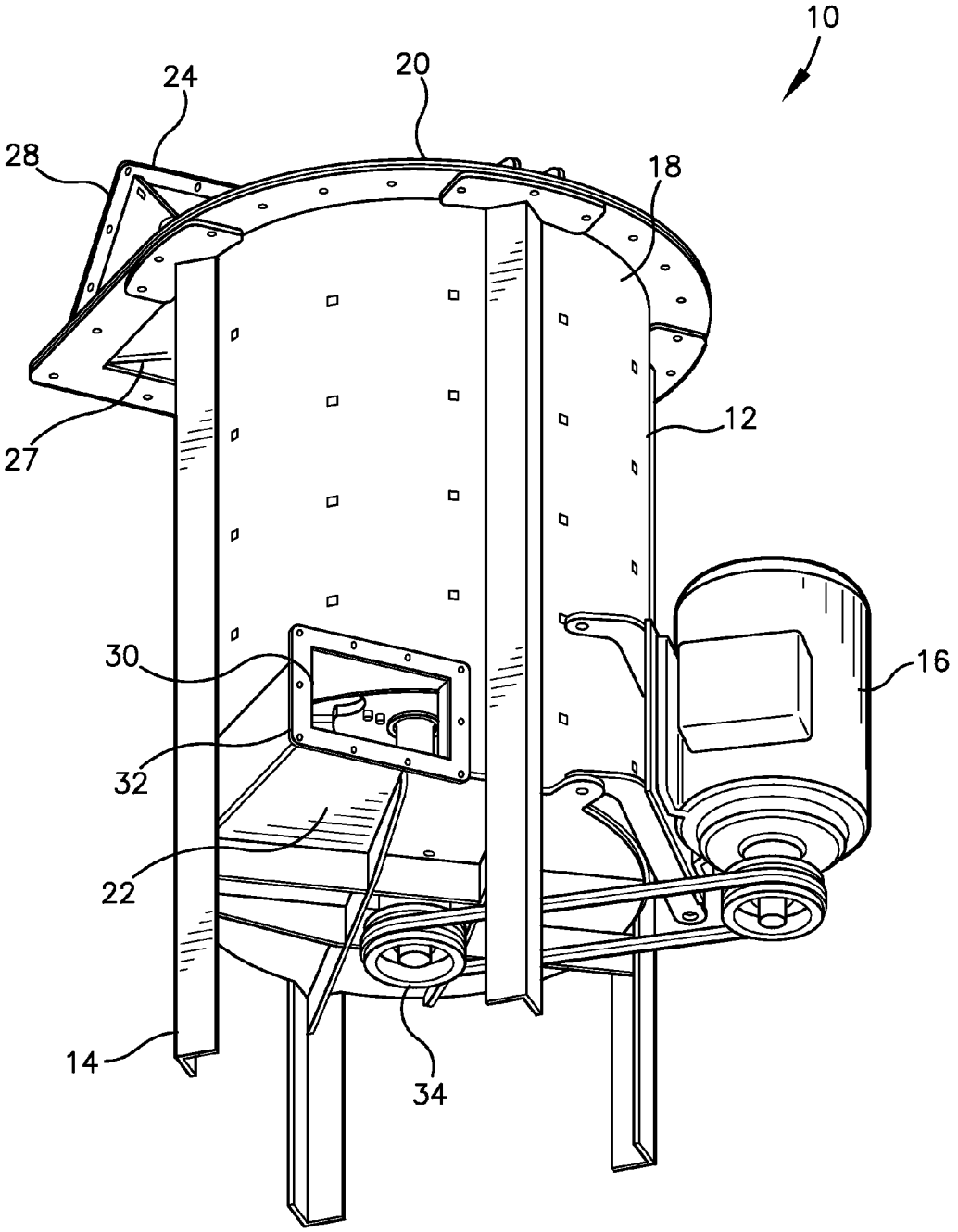
FIG. 2 is a perspective back side view of the grinding apparatus of FIG. 1.
Figure 3:
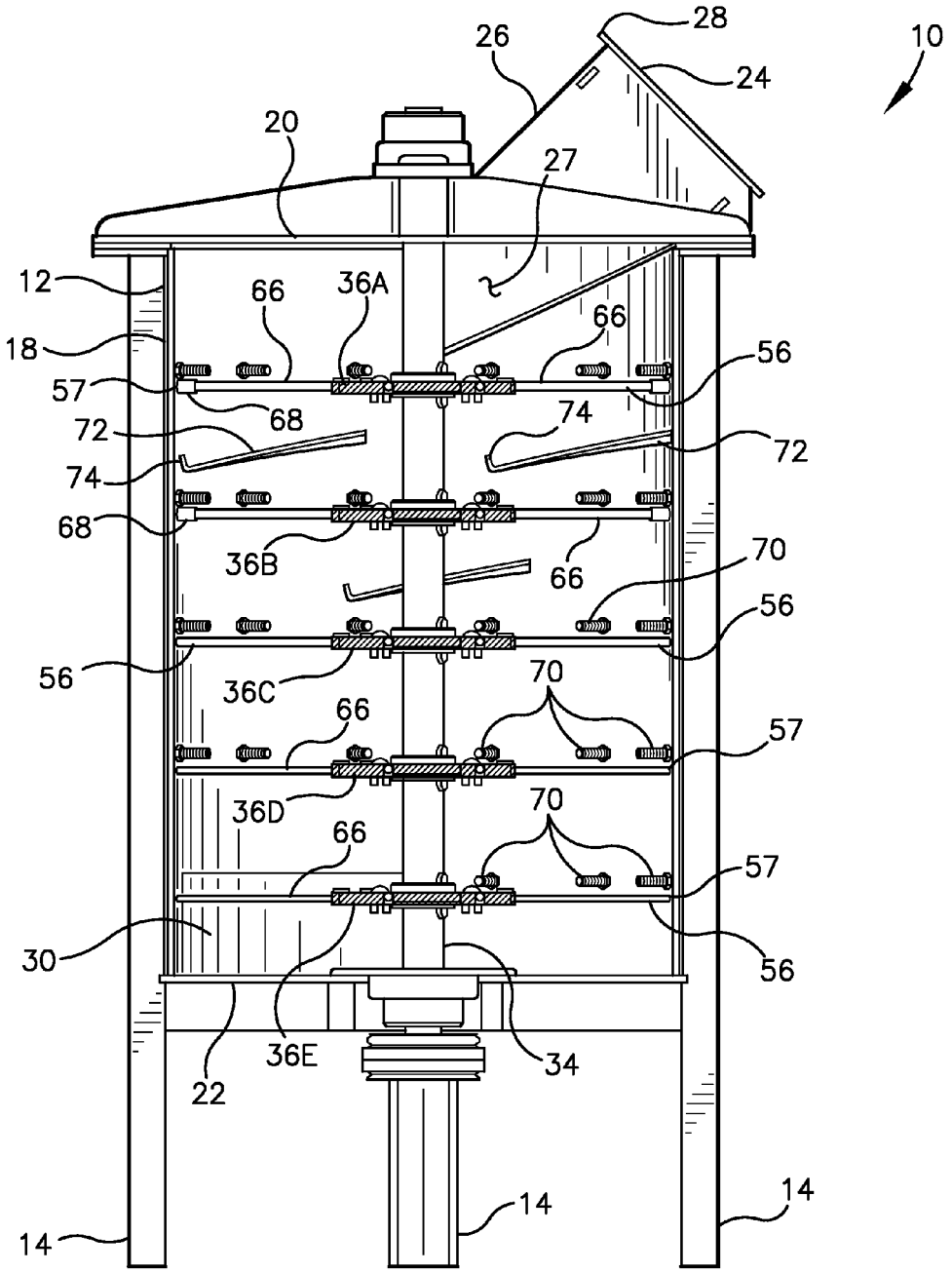
FIG. 3 is an elevational cross-sectional view taken along the line 3-3 depicted in FIG. 1.
Figure 4:
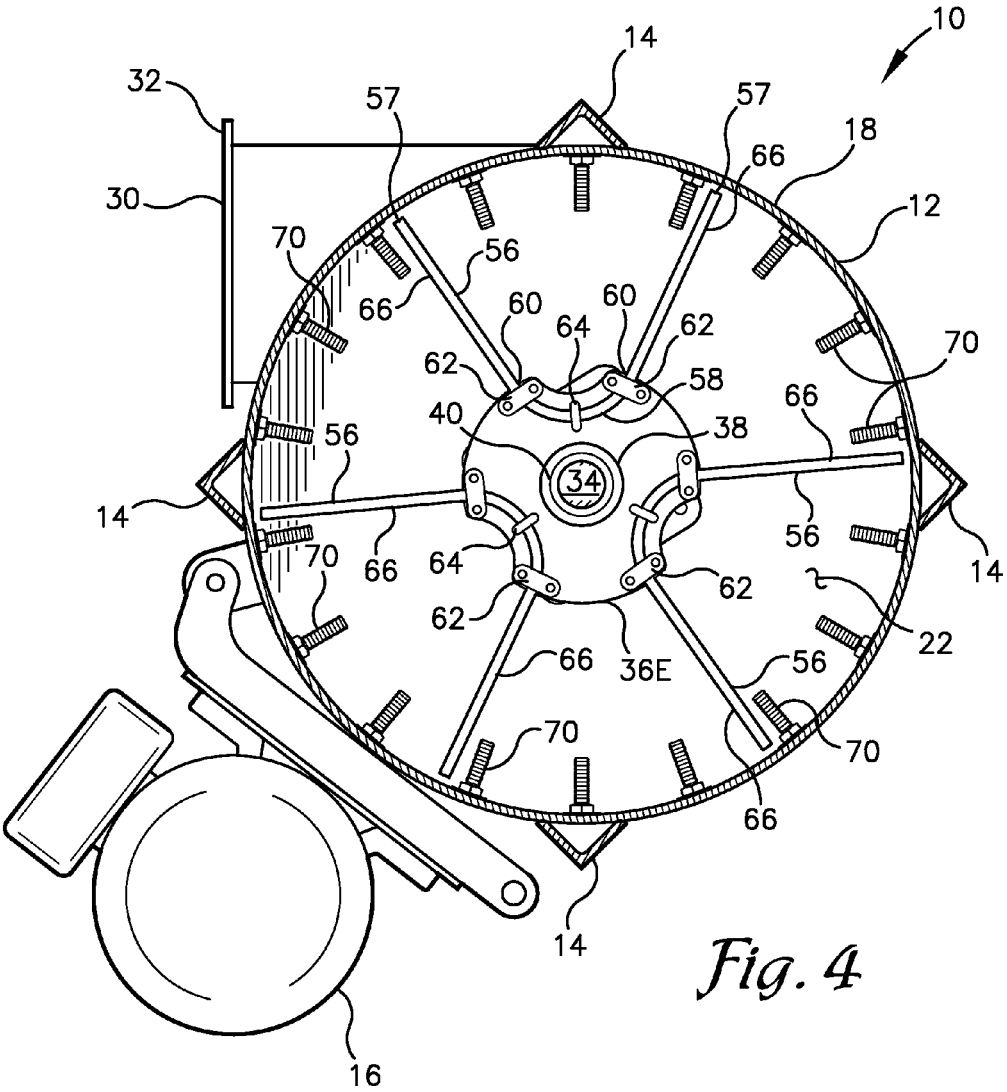
FIG. 4 is a cross-sectional plan view taken along the line 4-4 depicted in FIG. 1.
Figure 6:
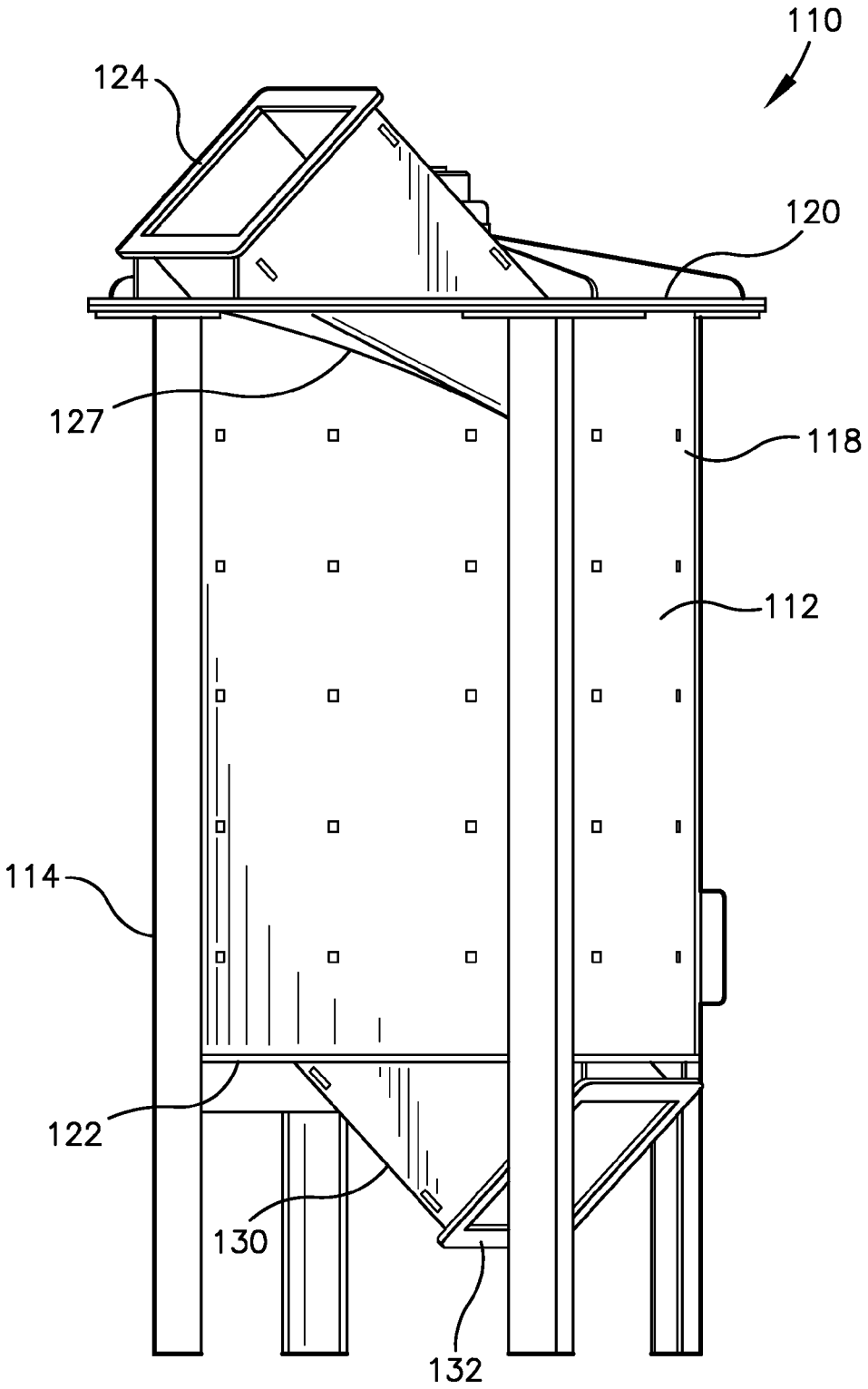
FIG. 6 is front perspective view of a grinding apparatus with an exit chute or funnel extending from a bottom surface in accordance with an embodiment of the invention.

An outlet chute 30 is disposed adjacent to or is integral with the bottom end-wall 22. As depicted in FIGS. 2-4, the outlet chute 30 extends tangentially from the annular wall 18 of the housing 12 with the bottom end-wall 22 forming a bottom wall thereof. The outlet chute 30 is configured to allow ground particulate materials traveling in a generally circular or spiraling path inside the housing 12 to exit the housing 12 along a generally tangential path and pass or flow to downstream material handling equipment or containers (not shown). The outlet chute 30 may also include a flange 32 along a distal edge for coupling to the downstream material handling equipment or containers. In another embodiment, depicted in FIG. 6, an outlet chute 130 extends through the bottom end-wall 122 along an angled and/or curved path similar to that of the intake chute 24 or might comprise a funnel-shaped portion of the bottom end-wall 22, as depicted by the outlet chute 130 of the grinder 110. The outlet chute 130 extending from the bottom end-wall 22 may provide better material flow for wet or moist materials.

A shaft 34 is rotatably mounted within the housing 12 and coaxially with therewith. The shaft 34 is rotatably coupled to the top and bottom end-walls 20, 22 and extends through the bottom end-wall 22 to mechanically couple to the motor 16 via one or more of belts, chains, sprockets, gears, or the like. The shaft 34 is thereby rotatable by the motor 16.

Figure 5:
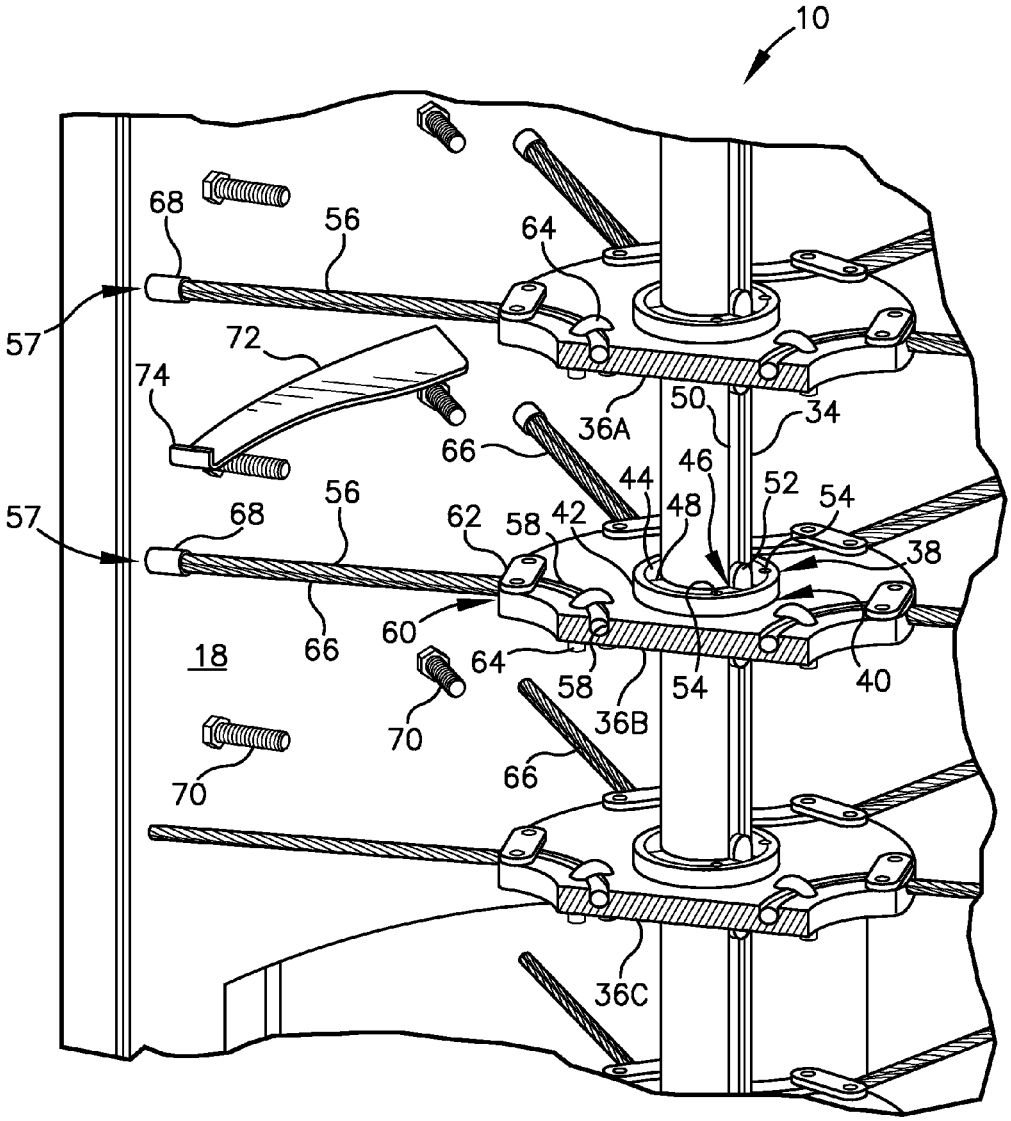
FIG. 5 is a enlarged partial cut-away perspective view of components in the interior of the grinding apparatus depicted in FIG. 1.

Referring to FIGS. 3-5, plurality of mounting plates 36 is disposed along the length of the shaft 34. The mounting plates 36 are evenly spaced apart along the length of the shaft 35 inside the housing 12 or can be located along the length as desired. The mounting plates 36 are coupled to the shaft 34 via taper-lock hubs 38, as best seen in FIG. 5. Each of the mounting plates 36 includes a central bore 40 in which an outer ring 42 of the taper-lock hub 38 is disposed and fixedly coupled therein, such as by welding. The outer ring 42 includes an interior diameter that is greater than the diameter of the shaft 34.

The hub 38 also includes an inner ring 44 that has a keyway 46 and a split 48 that allows the ring 44 to be flexed or compressed to decrease the diameter thereof. The outer circumference of the inner ring 44 is tapered and is configured for receipt by a mating tapered surface of the outer ring 42. As such, the mounting plate 36 is positioned at a desired location along the length of the shaft 34; the inner ring 44 is inserted between the outer ring 42 and the shaft 34. The keyway 46 of the inner ring 44 is aligned with a keyway 50 in the shaft 34 and a key 52 inserted therein to maintain rotational alignment between the shaft 34 and the inner ring 44. A plurality of fasteners 54 are inserted into the outer ring 42, the heads thereof engaging the inner ring 44 to draw the inner ring 44 into the space between the outer ring 42 and the shaft 34 and to compress the inner ring 44 against the shaft 34.

The mounting plates 36 are generally circular in shape and are each configured to retain a plurality of grinding members or cables 56 evenly spaced about the circumference thereof. The mounting plates 36 are described herein using three cables 56 each. However, it is understood that any number of cables 56 and associated components might be employed in embodiments of the invention without departing from the scope described herein. Further, the number of cables 56 coupled to each of the mounting plates 36 can be different, e.g. one mounting plate 36 might have five cables 56 while another might only have two cables 56.

The cables 56 preferably comprise high-strength steel cable, such as that known as crane cable or aircraft cable or may comprise any desired cable, wire, rope, or similar braided or non-braided strands. The cables 56 coupled to a particular mounting plate 36 preferably all have the same diameter so as to provide even weight distribution across the mounting plate 36 but other arrangements might be used. All of the mounting plates 36 can use cables 56 of the same diameter or the cables 56 can be varied. For example, as depicted in FIGS. 3 and 5, the cable diameter decreases from an uppermost mounting plate 36A to a bottom mount plate 36E, e.g. the uppermost mounting plate 36A employs ¼ inch diameter cables 56 while the succeeding lower mounting plates 36B-E use ¼ inch, ⅜ inch, ¼ inch, and ⅛ inch diameter cables respectively. Other configurations are understood as being within the scope of embodiments of the invention described herein.

Each cable 56 is coupled to a respective mounting plate 36 along a midsection thereof. The cable 56 is curved, bent, or folded at an angle such that opposite ends 57 thereof extend radially outward from the mounting plate 36 toward but not contacting the annular wall 18. The cable 56 is preferably curved at an acute angle of approximately about 60 degrees but may be bent into any acute, right, or obtuse angle as desired. In another embodiment, the cables 56 are remain substantially linear and are coupled to the mounting plate 36 such that opposite ends 57 of the cable 56 extend in opposite directions from opposite sides of the mounting plate 36. Or the cables 56 might be coupled to the mounting plate 36 with only a single end 57 extending therefrom.

For each of the cables 56, an arcuate, parabolic, or otherwise curved channel 58 is formed in a surface, generally the upper surface, of the mounting plate 36. The channel 58 is configured to accept one of the cables 56 therein. Ends 60 of the channel 58 are open to the circumference of the mounting plate 36 to allow the cable 56 to extend radially outward through the circumference. In another embodiment, the cables 56 are mounted on a surface of the mounting plate 36 without the use or provision of the channels 58. The channels 58 and their respective ends 60 are evenly spaced about the circumference of the mounting plate 36.

A retaining bracket 62 is positioned in overlying relationship with the channel 58 adjacent to each end 60 thereof and is retained in position by one or more fasteners. The retaining brackets 62 function to retain the cable 56 within the channel 58 and may clamp or compress the cable 58 therein. A U-bolt 64 or similar clamping feature is disposed at an apex of each channel 58 or at another location along the length of the channel 58. The U-bolt 64 extends through holes in the mounting plate 36 on opposite sides of the channel 58. The bite or cross-member of the U-bolt extends over the cable 56 for clamping, compressing, or otherwise anchoring the cable 56 to the mounting plate 36.

Figure 7A:
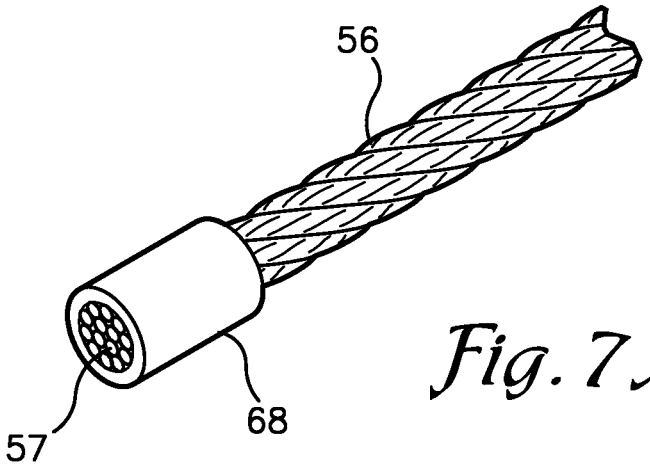
FIGS. 7A-C are perspective views of distal ends of cables employed in a grinding apparatus in accordance with an embodiment of the invention.
Figure 7B:
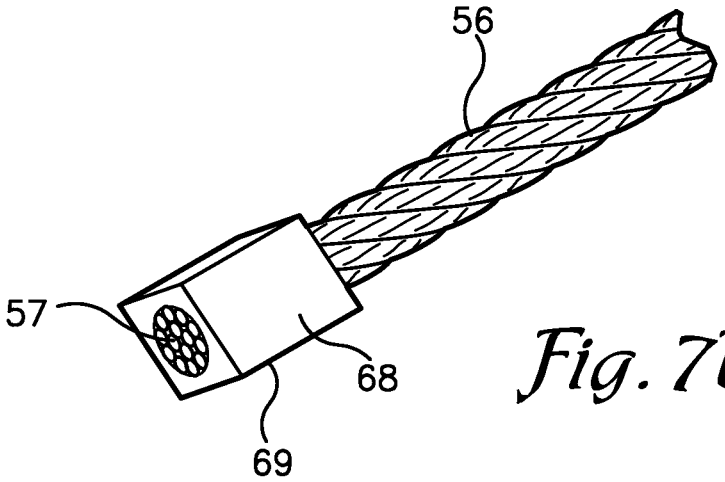
Figure 7C:
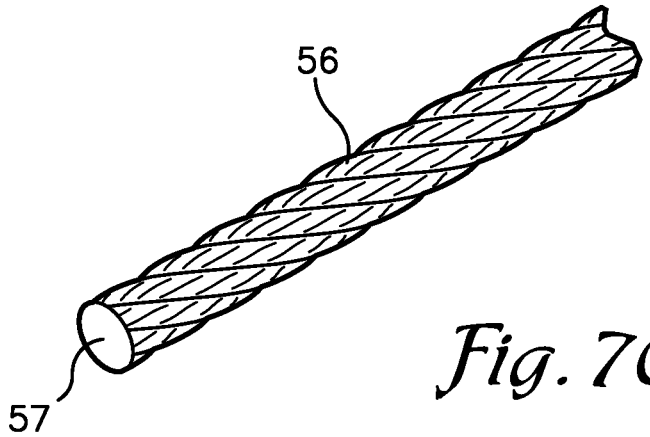

The portions of the cable 56 that extend from the mounting plate 36 form grinding arms 66 that contact and grind materials deposited in the grinder 10 as described more fully below. The ends 57 of the cables 56 include a collar 68 or other component coupled thereto, as depicted in FIGS. 7A-B. The collar 68 may comprise a hollow metallic cylinder or other form that is crimped, welded, or otherwise affixed around the end 57 of the cable to provide additional weight to the cable ends 57 and to restrict fraying of the ends 57 during grinding. The collar 68 might also be configured with a tapered or sharpened leading edge 69 as shown in FIG. 7B to aid in cutting of materials during grinding. The strands of the cable 56 can also be welded or melted together at the ends 57 to resist fraying as depicted in FIG. 7C.

Cutouts 67 may be formed in each mounting plate 36 to conserve material. In the embodiment shown, a cutout 67 is formed between the grinding arms 66 of the curved or bent cable 56.

As depicted in FIGS. 3-5, the housing 12 also includes a plurality of obstructing members 70 that extend inwardly from an interior surface of the annular wall 18. The obstructing members 70 comprise bolts, studs, flanges, or other features that are arranged about the interior surface of the annular wall 18 in vertically spaced apart horizontal planes or in another desired arrangement. The horizontal planes are vertically offset from the mounting plates 36 such that the cable ends 57 do not contact the obstructing members 70 during grinding. But the cable ends 57 overlap or underlap the obstructing members 70 and come into close proximity to the obstructing members 70 during grinding.

A plurality of fins or baffles 72 is also provided along the interior surface of the peripheral wall 18. They baffles 72 comprise generally triangular or rectangular flanges extending radially inwardly from the peripheral wall 18. The baffles 72 are disposed vertically offset from the mounting plates 36 to avoid contact between the baffles 72 and the ends 57 of the cables 56 during grinding. The baffles 72 extend a distance along the annular wall 18 in a generally horizontal orientation or may be angled slightly downward to aid in directing airflow and/or materials in a spiraling or cyclonic path through the housing 12. One or more baffles 72 can be provided between each of the mounting plates 36 or only between a selection of the mounting plates 36, e.g. only between the mounting plates 36A and B and between mounting plates 36B and C.

A tab or endplate 74 is optionally provided along a trailing edge of the baffle 72 and extends generally perpendicularly thereto. The endplate 74 acts to slow the airflow and/or the flow of materials around the interior of the housing 12.

An access hatch or door 76 is provided along the annular wall 18. The door 76 provides access to the interior of the housing 12 to allow clearing of debris, replacement of cables 56, and other general maintenance.

With continued reference to FIGS. 1-5, operation of the grinding mill 10 is described in accordance with an embodiment of the invention. Initially, the motor 16 is activated to begin rotation of the shaft 34 and thus the cables 56 or grinding arms 66 within the housing 12. The shaft 34 is preferably rotated at a rotational speed of greater than about 1,500 RPM, or greater than about 1,700 RPM, or more preferably about 1,780 RPM. Rotation of the shaft 34 and the grinding arms 66 generates airflow through the grinder 10; no fans or impellers are required to generate the airflow. The airflow enters the intake chute 24, spirals around the interior of the housing 12, and exits the outlet chute at a velocity of greater than about 10-20 miles per hour or more preferably approximately about 25 miles per hour or greater.

Materials to be ground, such as plastic, paper, paperboard, cardboard, or similar dry waste materials are deposited into the grinder 10 via the intake chute 24.

Other materials such as wet materials, raw and/or virgin materials might also be deposited. As the materials enter the housing 12 they are directed in a circular, spiraling, or cyclonic path around the interior of the grinder 10 by the airflow, contact with the grinding arms 66, and by the baffles 72. The endplates 74 on the baffles 72 may also act to slow the flow of the materials to increase the residence time in the grinder 10.

The grinding arms 66 repeatedly contact pieces of the material to grind, tear, pulverize or otherwise break the pieces down into smaller and smaller particulates as the material passes through the grinder 10. The grinding is aided by the obstructing members 70. As the material flows around the interior of the housing 12, pieces thereof become entangled, obstructed, or otherwise slowed by the obstructing members 70. As such, the material is struck by the grinding arms 66 with a greater amount of force and a greater number of times before exiting the grinder 10. And due to the close vertical proximity between the obstructing members 70 and the grinding arms 66, material that is entangled on or obstructed by the obstructing members 72 can be struck and torn between the grinding arms 66 and the obstructing members 72.

The grinding arms 66 of the upper most mounting plates 36A and B are comprised of larger diameter cables 56 while the lower mounting plates 36C-E utilize smaller diameter cables 56. As such, larger pieces of material entering the grinder 10 at the top are initially broken down by the larger diameter cables 56 whose weight and size is more suitable for the larger pieces of material. The material is thus reduced to generally smaller sized pieces that can be subsequently further broken down by progressively smaller diameter cables 56. Thus, large diameter cables 56 are used to break down large pieces of material while smaller diameter cables 56 are used to break down smaller material particulates.

Upon reaching the bottom end of the housing 12, the ground, reduced size material particulate is expelled from the grinder 10 through the outlet chute 30 by the airflow and by the centrifugal force associated with the material as it moves around the interior of the housing 12. The material can be passed to downstream material handling equipment such as conveyors or to one or more containers for further processing, shipment, storage, or use. The particulate material might also be expelled using gravity in embodiments having the outlet chute 130 disposed in the bottom end-plate 122 as in the grinder 110 depicted in FIG. 6.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A grinder comprising:

a cylindrical housing having a rotatable shaft disposed coaxially therein;

a plurality of cables removeably coupled to the shaft along the length thereof in one or more spaced apart, radially extending planes, each of the cables extending radially outward from the shaft toward but not contacting a sidewall of the housing, the cables being moved through the radial planes by rotation of the shaft and contacting materials deposited in the housing for grinding, and the movement of the cables generating an airflow through the housing; and a plurality of mounting plates fixedly coupled to the shaft, each of the mounting plates being disposed in a respective one of the radially extending planes and extending parallel to the other mounting plates in the plurality, each of the mounting plates including one or more channels formed in an axial face thereof, and each of the cables being coupled to a respective mounting plate in a respective channel.

2. The grinder of claim 1, wherein each channel includes a clamp disposed across the channel near a midpoint thereof that anchors the cable within the channel, and a retaining bracket is fastened across the channel near an end thereof to retain the cable within the channel.

3. The grinder of claim 1, wherein a midsection of each cable is coupled to the shaft and opposite ends of the cable extend radially outward from the shaft.

4. The grinder of claim 1, wherein the cables disposed near the top of the grinder have a larger diameter than cables disposed nearer to the bottom of the grinder.

5. The grinder of claim 1, wherein distal ends of the cables are welded to reduce fraying of the cables.

6. The grinder of claim 1, wherein a collar is affixed to a distal end of one or more of the cables.

7. The grinder of claim 6, wherein the collar includes a tapered leading edge.

8. The grinder of claim 1, wherein one or more substantially planar baffles are coupled to the sidewall of the housing and extend radially inward a distance, the baffles being disposed to extend an axial distance between the radially extending planes of the cables and along less than half of an interior circumference of the housing.

9. The grinder of claim 8, wherein one or more of the baffles includes an endplate extending at an angle from the baffle that slows the airflow and a flow of the materials through the housing.

10. The grinder of claim 1, further comprising:

a plurality of obstructing members extending radially inwardly from the sidewall in close proximity to the radial planes of the cables but offset therefrom, the obstructing members aiding grinding of the materials deposited in the grinder.

11. A vertically oriented grinder comprising:

a cylindrical housing having a rotatable shaft disposed coaxially therein;

a plurality of mounting plates fixedly coupled to the shaft, spaced apart along the length thereof, and oriented parallel to one another;

a plurality of cables coupled to each of the mounting plates and extending radially outward toward but not contacting a sidewall of the housing, the cables being moved through a radial plane by rotation of the shaft and contacting materials deposited in the housing for grinding, and the shaft being rotated at a sufficient rotational speed to cause the movement of the cables to generate an airflow leaving the housing through an outlet at a speed of greater than about 20 miles per hour.

12. The grinder of claim 11, wherein each of the cables is removeably coupled to a respective mounting plate centrally along the length of the cable, each end of the cable extending radially outward from the mounting plate to provide a pair of grinding arms.

13. The grinder of claim 11, further comprising:

a plurality of baffles extending inwardly from the sidewall and disposed vertically offset from the mounting plates, the baffles extending an axial distance between the radially extending planes and circumferentially along a portion of an interior surface of the housing.

14. The grinder of claim 11, further comprising:

a plurality of obstructing members extending radially inwardly from the sidewall vertically offset from the radial planes of the cables, the obstructing members aiding grinding of the materials deposited in the grinder.

15. A vertically oriented grinder comprising:

a cylindrical housing having an intake chute disposed in a top wall thereof and an outlet chute in a bottom wall thereof;

a rotatable shaft disposed in the housing and coaxially therewith, the shaft being rotated at a rotational speed of greater than about 1500 revolutions per minute;

a plurality of mounting plates fixedly coupled to the shaft, spaced apart along the length thereof, and oriented parallel to one another;

a plurality of cables coupled to each of the mounting plates and opposing ends of each of the cables extending radially outward toward but not contacting a sidewall of the housing, each of the opposing ends including a collar affixed thereto, the cables being moved through respective radial planes by rotation of the shaft and contacting materials deposited in the housing for grinding, and the movement of the cables generating an airflow from the intake chute through the housing to the outlet chute.

16. The grinder of claim 15, wherein the outlet chute extends from the bottom wall of the housing at an angle and in a direction that is tangential to the sidewall of the housing.

17. The grinder of claim 15, wherein the outlet chute comprises an aperture in a bottom wall of the housing, and wherein the bottom wall of the housing is funnel shaped.

18. The grinder of claim 15, wherein the materials deposited into the grinder include one or more of paper, cardboard, and plastics.

* * * * *